US006536379B1

(12) United States Patent
Liu

(10) Patent No.: US 6,536,379 B1
(45) Date of Patent: Mar. 25, 2003

(54) STEAM CLEANING DEVICE

(76) Inventor: Yin-Tao Liu, No. 7, Lane 493, Sec. 3, Chung-Shan Rd., Tan-Tzu Hsiang, Taichung Hsien (TW)

( * ) Notice: Subject to any disclaimer, the term of this patent is extended or adjusted under 35 U.S.C. 154(b) by 0 days.

(21) Appl. No.: 10/080,727

(22) Filed: Feb. 22, 2002

(51) Int. Cl.[7] ..... F22B 37/18

(52) U.S. Cl. ..... 122/379; 15/320; 15/322; 68/5 A

(58) Field of Search ..... 122/379, 404, 122/405; 392/470, 473, 476, 477; 15/320, 321, 322; 134/105, 108, 198; 68/5 A, 5 R

(56) References Cited

U.S. PATENT DOCUMENTS 3,702,616 A * 11/1972 Mercer ..... 132/272
5,224,237 A * 7/1993 Ambrosiano ..... 15/322
6,112,367 A * 9/2000 Burr et al. ..... 15/401
6,314,972 B1 * 11/2001 Sin ..... 134/105
6,321,037 B1 * 11/2001 Reid et al. ..... 392/473

* cited by examiner

*Primary Examiner*—Gregory Wilson
(74) *Attorney, Agent, or Firm*—Harness, Dickey & Pierce, P.L.C.

(57) ABSTRACT

A steam cleaning device includes a conduit with a passageway to be aligned and in fluid communication with a duct of a steam generating member secured in a housing. A steam delivering head is removably inserted into and is aligned with the passageway of the conduit such that a channel thereof is in fluid communication with the passageway and such that steam generated by the steam generating member is released out through the passageway and a channel of the steam delivering head. Thus, when the steam delivering head is removed from the passageway, water scales attached to the duct and the channel can be removed by cleaning the same.

6 Claims, 6 Drawing Sheets

STEAM CLEANING DEVICE

BACKGROUND OF THE INVENTION

1. Field of the Invention

This invention relates to a steam cleaning device, more particularly to a handheld steam cleaning device in which water scales formed therein can be removed without the need to disassemble two housing walls thereof.

2. Description of the Related Art

Referring to FIGS. 1 and 2, a conventional steam cleaning device is shown to include a housing 10 which has two complementary housing walls mating with each other to confine an accommodation chamber therein. A steam generating member 20 is received in the accommodation chamber, and has a heating tube 203 with a water inlet 201 that is in fluid communication with a tube 303 of a water supplying member 30. The water supplying member 30 further includes a reservoir 301, and a pump 302 which pumps water in the reservoir 301 to the water inlet 201. The heating tube 203 further has a steam outlet 202 in which steam is generated. A steam delivering member 40 has a passageway 405 with two ends 4012,4021, and includes a connecting portion 401 which is held in the accommodation chamber by an engaging portion 4011 that engages a positioning portion 101 of the housing 10, and a nozzle 402 which extends outwardly of the housing 10. The end 4012 is in fluid communication with the steam outlet 202 such that the steam can be directed out of the end 4021 for spraying and removal of dirt on a surface. A regulator 404 is secured to a receiving groove 403 defined between the connecting portion 401 and the nozzle 402. In assembly, after engagement of the connecting and positioning portions 401,101, a plurality of fasteners (not shown) are used to fasten the housing walls together.

Since the heating tube 203 and the passageway 405 must be cleaned to remove water scales formed thereon after long term use, the fasteners must be removed from the housing 10 to separate the housing walls from each other. Then, the steam delivering member 40 is detached from the accommodation chamber so that a brush (not shown) can reach the heating tube 203 and the passageway 405 for cleaning. Therefore, the cleaning operation is inconvenient to conduct.

SUMMARY OF THE INVENTION

The object of the present invention is to provide a steam cleaning device which permits removal of water scales formed therein without the need to disassemble a housing thereof.

According to this invention, the steam cleaning device includes a housing which has front and rear portions opposite to each other in a lengthwise direction, and an intermediate portion interposed therebetween. The housing confines an accommodation chamber which extends through the front, intermediate and rear portions. The front portion has a surrounding abutment wall which extends in a transverse direction relative to the lengthwise direction and which defines an opening that is communicated with the accommodation chamber. A steam generating member is disposed in the accommodation chamber at the rear portion, and includes a first inner tubular wall which extends in the lengthwise direction. The first inner tubular wall confines a duct, and includes a post-heating zone segment proximate to the intermediate portion. A conduit is disposed in the lengthwise direction, and includes a second inner tubular wall which confines a passageway. The conduit includes a proximate end which engages the post-heating zone segment such that the passageway is aligned and is in fluid communication with the duct, and a distal end which is disposed in the accommodation chamber at the intermediate portion. A steam delivering head has a channel which extends therethrough in the lengthwise direction, and includes an insert end which is insertable into the passageway and which is in sealing contact with the second inner tubular wall while bringing the channel into alignment and fluid communication with the passageway, a barrel body which extends from the insert end and outwardly and forwardly of the distal end to terminate at a surrounding edge wall, and a barrier wall which extends from the surrounding edge wall in the transverse direction to cooperate with the barrel body to form a shoulder wall. When the insert end is inserted into the passageway, the shoulder wall abuts against the surrounding abutment wall, thereby guarding against further movement of the insert end in the lengthwise direction. A tightening member is disposed to bring the shoulder wall in the lengthwise direction to abut firmly against the surrounding abutment wall.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
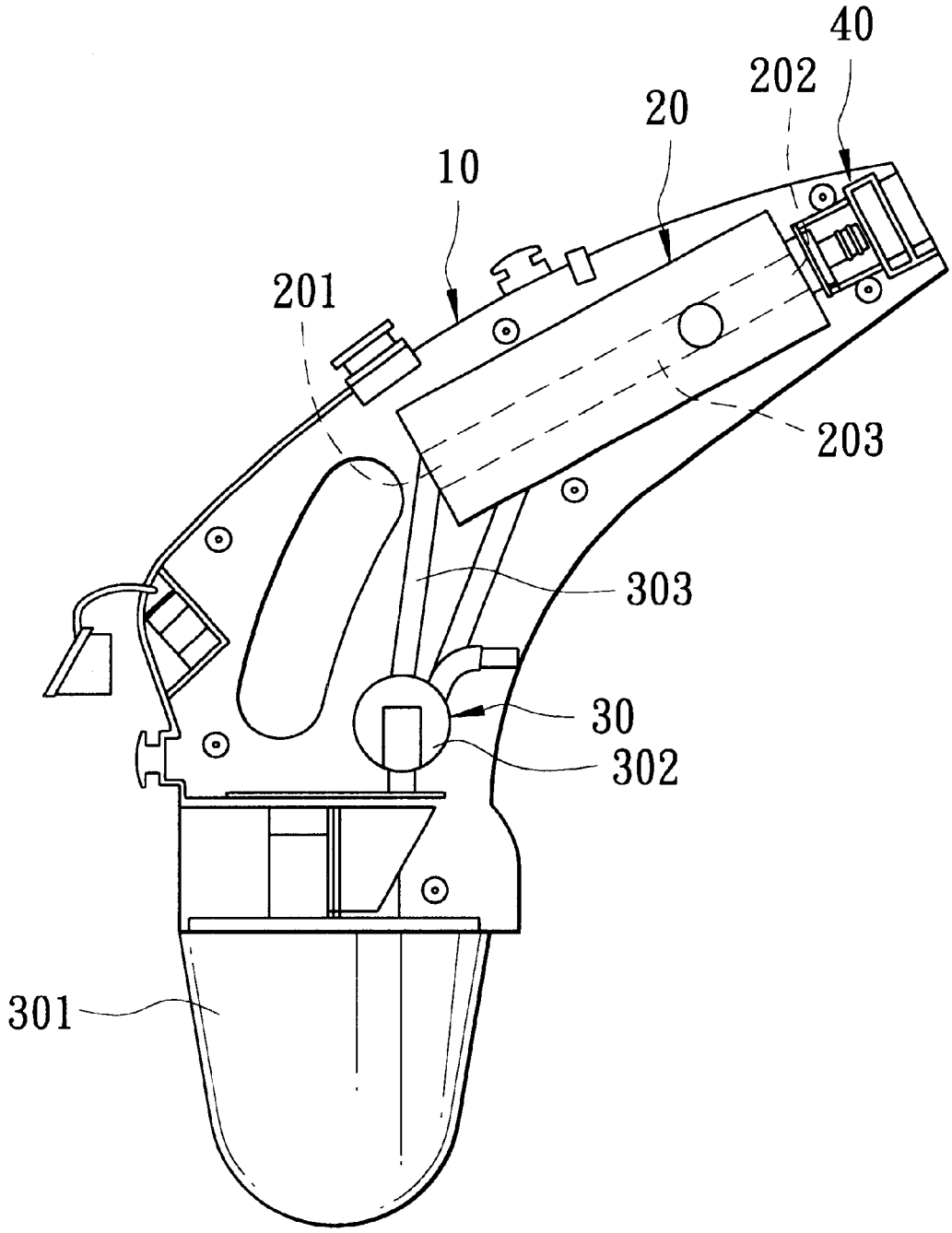
FIG. 1 PRIOR ART
FIG. 1 is a schematic view of a conventional steam cleaning device.
Figure 2:
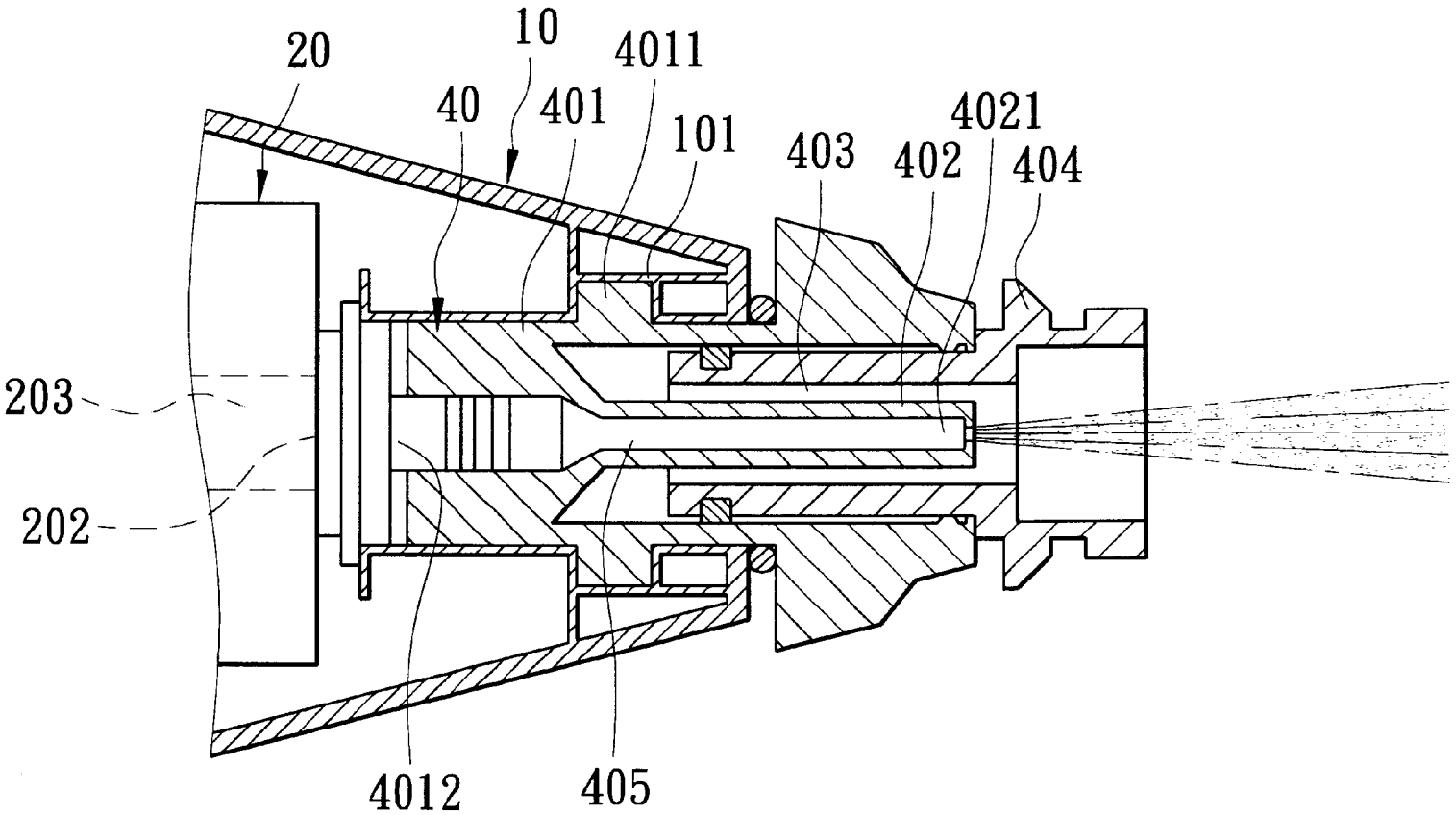
FIG. 2 PRIOR ART
FIG. 2 is a sectional view of a portion of the conventional steam cleaning device.
Figure 3:
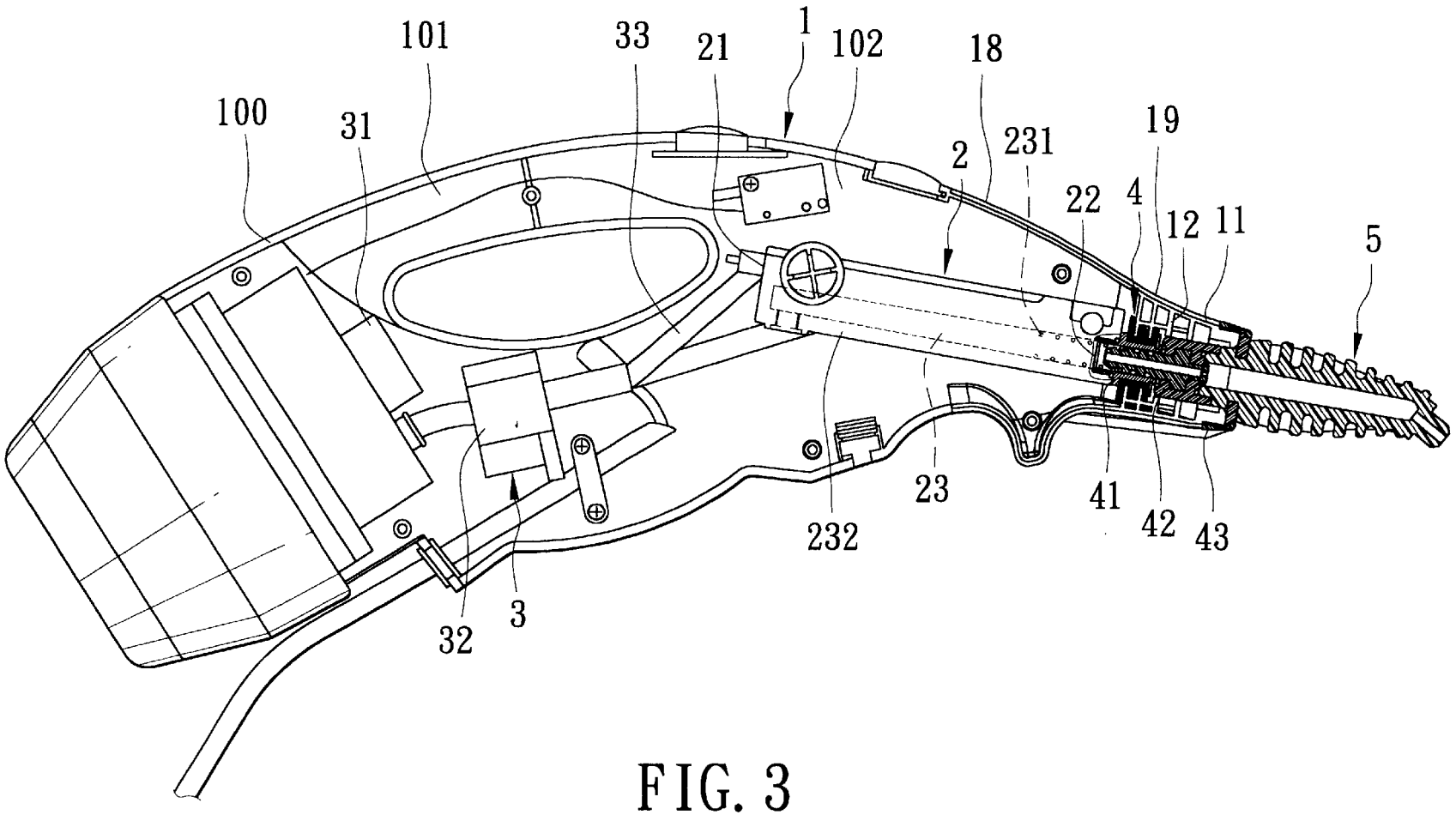
FIG. 3 is a partly sectional schematic view of a preferred embodiment of a steam cleaning device according to this invention.
Figure 4:
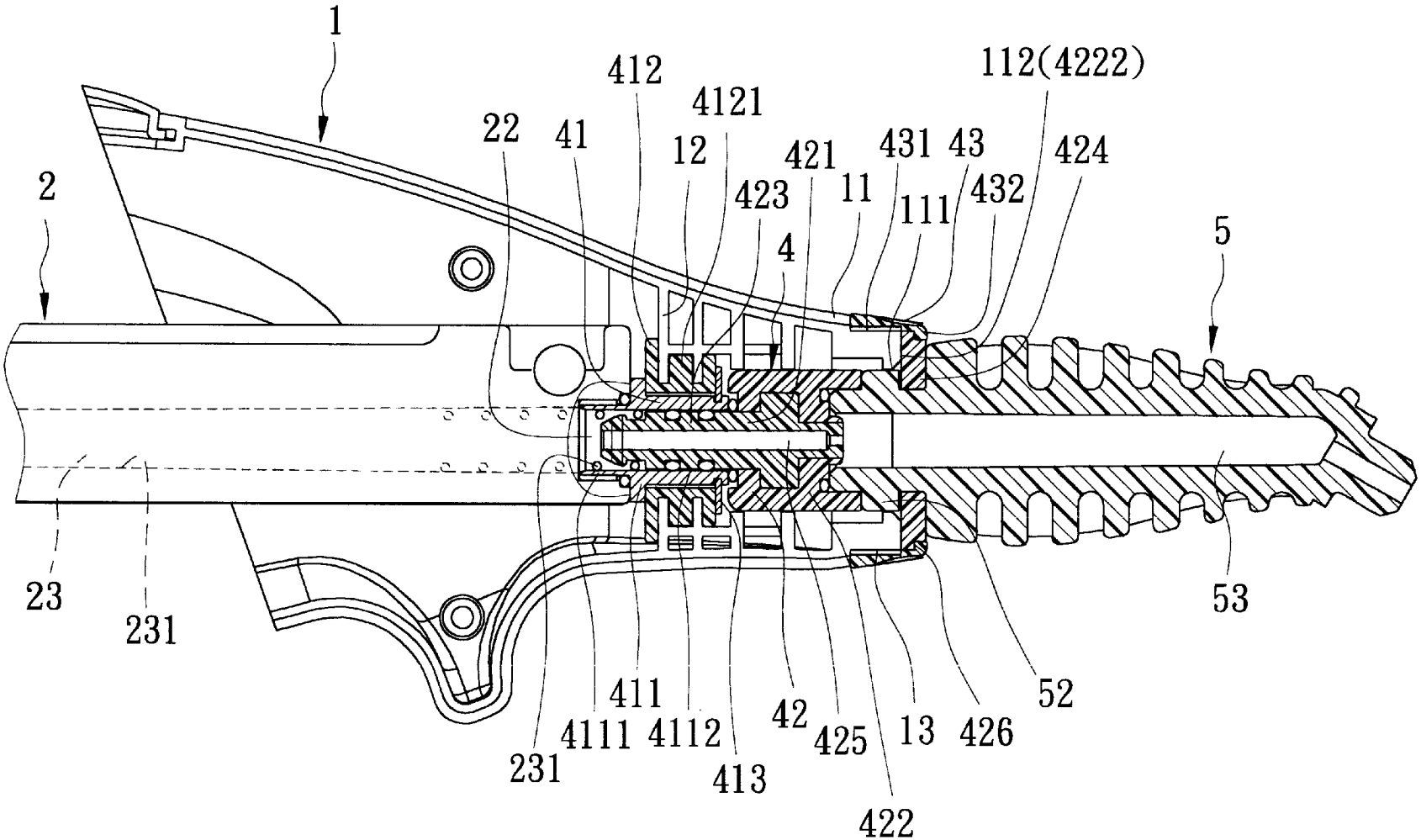
FIG. 4 is a partly sectional schematic view of a portion of the preferred embodiment.
Figure 6:
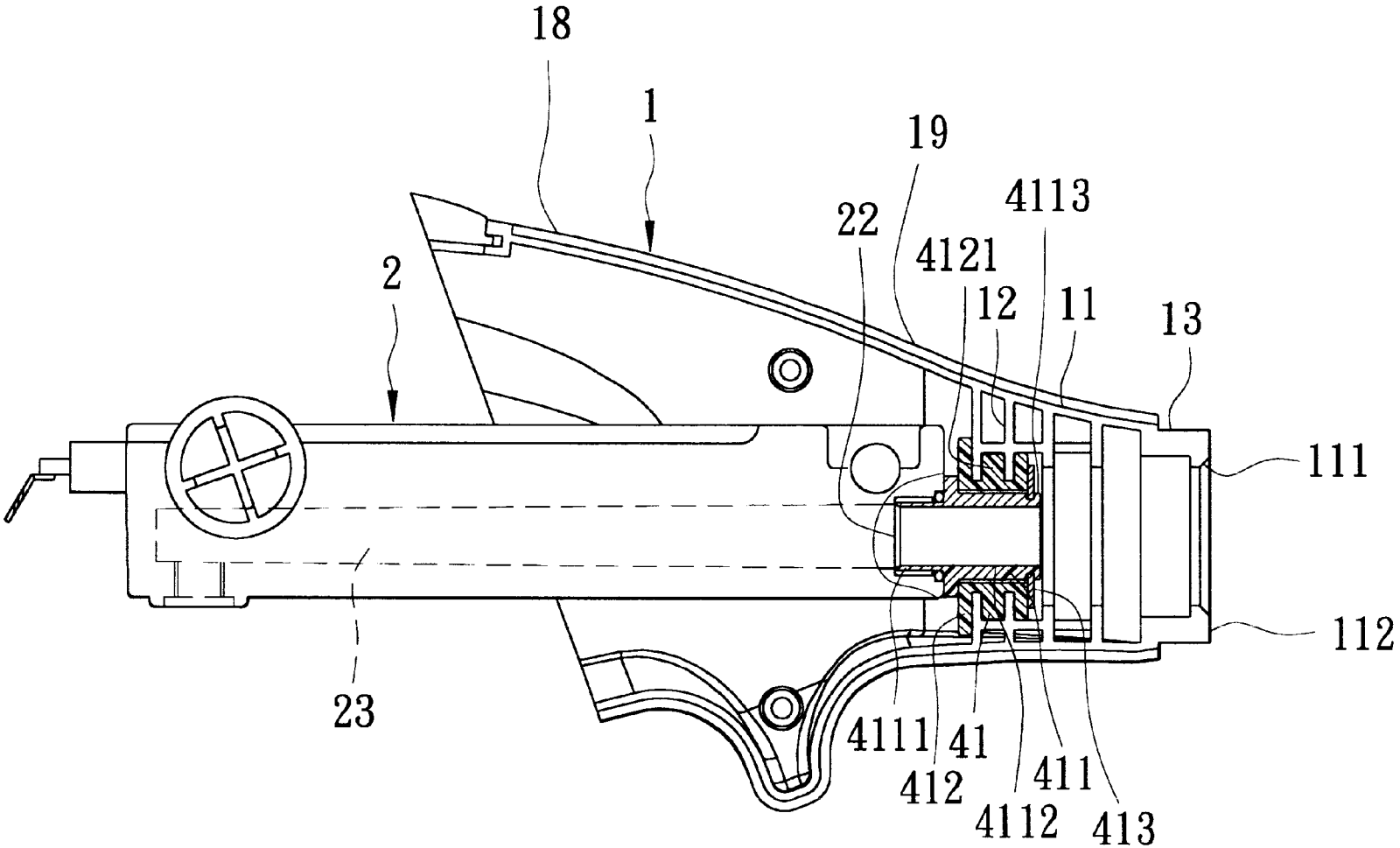
FIG. 6 is a partly sectional schematic view of the preferred embodiment, the steam delivering head, the nozzle, and a tightening nut thereof being removed for the sake of clarity.

Referring to FIGS. 3, 4 and 6, the preferred embodiment of the steam cleaning device according to the present invention is shown to comprise a housing 1 which includes two complementary housing walls 100 (only one housing wall is shown) disposed opposite to each other in a widthwise direction. The housing walls 100 have peripheries which mate complementarily with each other to define an accommodation chamber. The housing 1 has a rear handle segment 101 for receiving a water supplying member 3 with a reservoir 31, a pump 32 and a connecting tube 33 in a known manner for supplying water, and a front barrel segment 102 forwardly of the rear handle segment 101. The front barrel segment 102 includes front and rear portions 11,18 opposite to each other in a lengthwise direction, and an intermediate portion 19 which is interposed between the front and rear portions 11,18. The accommodation chamber in the front barrel segment 102 extends in the lengthwise direction and through the front, intermediate and rear portions 11,19,18. The front portion 11 has a surrounding abutment wall 112 which extends in a transverse direction relative to the lengthwise direction and which defines an opening 111 that is communicated with the accommodation chamber in the lengthwise direction. An externally threaded portion 13 is formed on an outer surrounding wall surface of the front portion 11, and extends in the lengthwise direction. A positioning portion 12 is formed on an inner peripheral wall surface of the intermediate portion 19.

A steam generating member 2 is disposed in the accommodation chamber at the rear portion 18, and includes a first inner tubular wall 232 extending in the lengthwise direction. The first inner tubular wall 232 confines a duct 23, and includes a post-heating zone segment 22 proximate to the intermediate portion 19, and a water inlet 21 opposite to the post-heating zone segment 22 to engage the tube 33 so as to convert water supplied from the water supplying member 3 into steam.

A steam delivering mechanism 4 includes a securing unit 41 and a removable steam delivering head 42. The securing unit 41 includes a metal conduit 411 and a plastic connecting member 412. The conduit 411 has a second inner tubular wall which confines a passageway 4112, a proximate end 4111 which is disposed to engage sealingly the post-heating zone segment 22 such that the passageway 4112 is aligned and is in fluid communication with the duct 23, and a distal end 4113 which is disposed opposite to the proximate end 4111 in the lengthwise direction and which is disposed in the accommodation chamber at the intermediate portion 19. The connecting member 412 is sleeved on the steam delivering head 42, and has engaging portions 4121 to engage the positioning portion 12. An E-shaped snap ring 413 is disposed in an annular groove in the distal end 4113 to abut against the connecting member 412 so as to secure the conduit 411 onto the connecting member 412.

Figure 5:
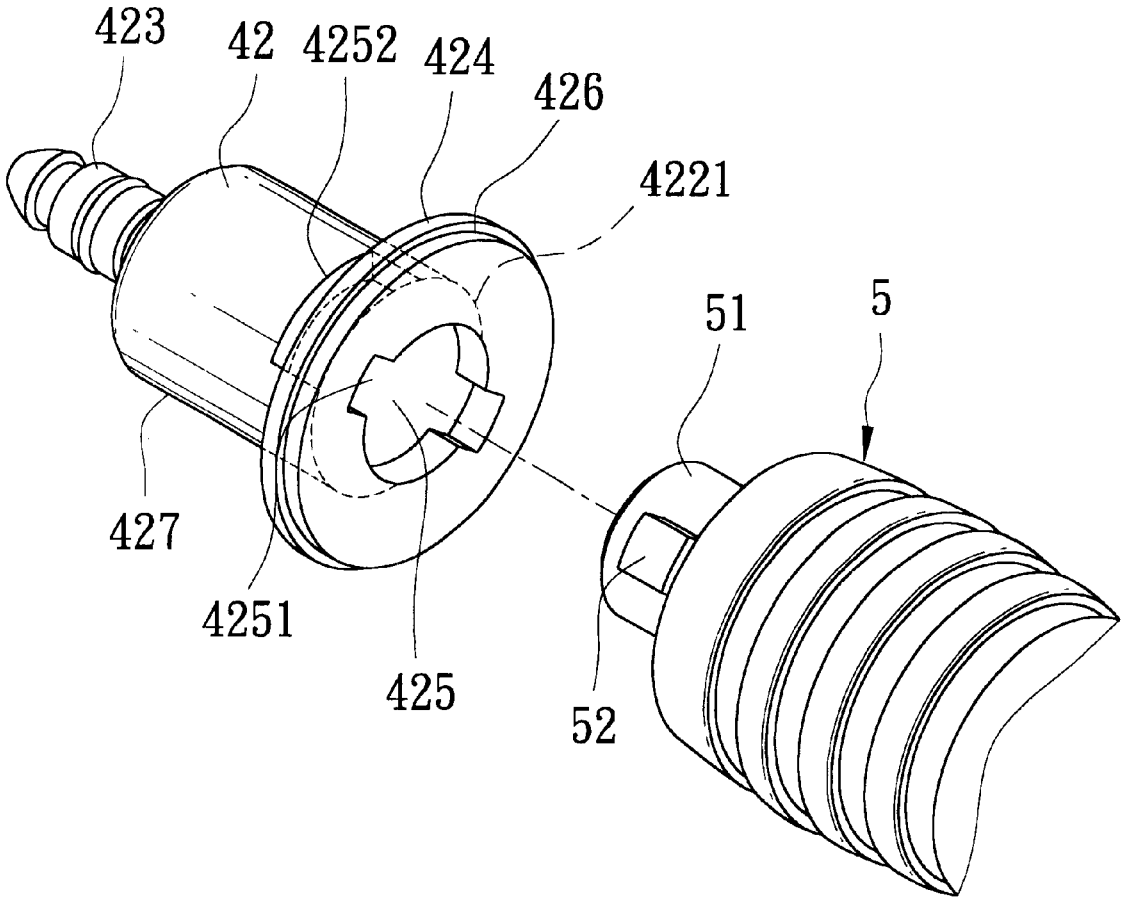
FIG. 5 is an exploded perspective view showing a steam delivering head and a nozzle of the preferred embodiment.

With reference to FIG. 5, the steam delivering head 42 has a channel 425 which extends therethrough in the lengthwise direction, and is composed of an insert part 421 and a seat part 422 that engage each other. The steam delivering head 42 includes an insert end 423 which is insertable into the passageway 4112 and which is in sealing contact with the second inner tubular wall by O-rings while bringing the channel 425 into alignment and in fluid communication with the passageway 4112, and a barrel body 427 which extends from the insert end 423 and outwardly and forwardly of the distal end 4113 of the conduit 411 and which terminates at a surrounding edge wall 4221 that is insertable into the opening 111. The steam delivering head 42 further includes a barrier wall 424 which extends from the surrounding edge wall 4221 in the transverse direction, and which cooperates with the barrel body 427 to form a shoulder wall 4222. As such, when the insert end 423 is inserted into the passageway 4112 in the lengthwise direction, the shoulder wall 4222 abuts against the surrounding abutment wall 112 of the housing 1, thereby guarding against further movement of the insert end 423 in the lengthwise direction. Moreover, two diametrically opposite notches 4251 are formed in the barrier wall 424 to communicate with the channel 425. An engaging hole 4252 is formed in the barrel body 427 proximate to the shoulder wall 4222 and is displaced angularly relative to the notches 4251. A stepped portion 426 is formed on an outer surrounding wall surface of the barrier wall 424.

A tightening member includes a screw nut 43 with an internally threaded portion 431 which engages threadedly the externally threaded portion 13 of the housing 1 in the lengthwise direction, and an abutting edge portion 432 which is disposed opposite to the internally threaded portion 431 in the lengthwise direction to abut against the stepped portion 426 so as to tighten the shoulder wall 4222 onto the surrounding abutment wall 112 in the lengthwise direction.

In assembly, the conduit 411 is first connected to the post-heating zone segment 22, the connecting member 412 is positioned by the positioning portion 12 of the housing 1, and the conduit 411 is secured by the snap ring 413. Then, a plurality of fasteners (not shown) are used to secure the housing walls 10 to each other to confine the opening 111 at the front portion 11 thereof. Thus, the insert end 423 of the steam delivering head 42 can be inserted into the passageway 4112 of the conduit 411 in the housing 1. Finally, the steam delivering head 42 is secured to the housing 1 by means of the screw nut 43.

In use, a nozzle 5 has an insert plug 51 with engaging blocks 52 (only one is shown) which can pass through the notches 4251 in the lengthwise direction and which can be turned to engage the engaging hole 4252 so as to connect securely the nozzle 5 to the steam delivering head 42. The nozzle 5 has a steam outlet 53 which is in fluid communication with the channel 425 to allow the steam to be released therefrom.

When it is desired to clean the duct 23 of the steam generating member 2 and the steam delivering head 42, the screw nut 43 is screwed out to permit the steam delivering head 42 to be pulled out from the passageway 4112 in the lengthwise direction, whereby the cleaning operation is convenient to conduct without the need to disassemble the housing walls 100.

Preferably, a coil spring 231 is disposed in the duct 23, and has a first end secured to the post-heating zone segment 22 and a second end sleeved on the insert end 423 so as to bias the steam delivering head 42 inwardly against a steam pressure of the steam.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A steam cleaning device comprising:

a housing including front and rear portions opposite to each other in a lengthwise direction, and an intermediate portion which is interposed between said front and rear portions, said housing confining an accommodation chamber which extends in the lengthwise direction and through said front, intermediate and rear portions, said front portion having a surrounding abutment wall which extends in a transverse direction relative to the lengthwise direction and which defines an opening that is communicated with said accommodation chamber in the lengthwise direction;

a steam generating member disposed in said accommodation chamber at said rear portion, and including a first inner tubular wall which extends in the lengthwise direction, said first inner tubular wall confining a duct, and including a post-heating zone segment proximate to said intermediate portion;

a conduit disposed in the lengthwise direction, and including a second inner tubular wall which confines a passageway, said conduit including a proximate end which is disposed to engage said post-heating zone segment such that said passageway is aligned and is in fluid communication with said duct, and a distal end which is disposed opposite to said proximate end in the lengthwise direction and which is disposed in said accommodation chamber at said intermediate portion;

a steam delivering head having a channel which extends therethrough in the lengthwise direction, and including an insert end configured to be insertable into said passageway and in sealing contact with said second inner tubular wall while bringing said channel into alignment and fluid communication with said passageway, a barrel body extending from said insert end and outwardly and forwardly of said distal end, and terminating at a surrounding edge wall configured to be insertable into said opening, and a barrier wall extending from said surrounding edge wall in the transverse direction, and cooperating with said barrel body to form a shoulder wall, such that when said insert end is inserted into said passageway in the lengthwise direction, said shoulder wall abuts against said surrounding abutment wall, thereby guarding against further movement of said insert end in the lengthwise direction; and a tightening member disposed to bring said shoulder wall in the lengthwise direction to abut firmly against said surrounding abutment wall.

2. The steam cleaning device of claim 1, wherein said tightening member includes an externally threaded portion disposed on said front portion of said housing and extending in the lengthwise direction, and a screw nut having an internally threaded portion disposed to engage threadedly said externally threaded portion in the lengthwise direction, and an abutting edge portion disposed opposite to said internally threaded portion in the lengthwise direction and configured to abut against said barrier wall when said internally and externally threaded portions engage threadedly each other so as to tighten said shoulder wall onto said surrounding abutment wall.

3. The steam cleaning device of claim 1, wherein said housing includes two complementary housing walls disposed opposite to each other in a widthwise direction, and respectively having peripheries which mate complementarily with each other to define said accommodation chamber.

4. The steam cleaning device of claim 3, wherein said conduit is secured to said intermediate portion of said housing so as to be held in said housing when said insert end of said steam delivering head is removed from said passageway in the lengthwise direction.

5. The steam cleaning device of claim 1, further comprising a coil spring having a first end secured to said post-heating zone segment, and a second end sleeved on said insert end to bias said steam delivering head rearwardly against pressure of generated in said steam generating member.

6. The steam cleaning device of claim 1, further comprising a nozzle detachably connected to said barrel body, and having a steam outlet which is in fluid communication with said channel.

* * * * *